US007927053B2

(12) United States Patent
Brommer et al.

(10) Patent No.: US 7,927,053 B2
(45) **Date of Patent: *Apr. 19, 2011**

(54) BINDING-IN MACHINE WITH BOOK DELIVERY

(75) Inventors: Carsten Brommer, Tecklenburg/Leeden (DE); Manfred Albrecht, Luebbecke (DE)

(73) Assignee: Kolbus GmbH & Co., KG, Rahden (DE)

( * ) Notice: Subject to any disclaimer, the term of this patent is extended or adjusted under 35 U.S.C. 154(b) by 707 days.

This patent is subject to a terminal disclaimer.

(21) Appl. No.: 11/999,086

(22) Filed: Dec. 4, 2007

(65) Prior Publication Data

US 2008/0136158 A1 Jun. 12, 2008

(30) Foreign Application Priority Data

Dec. 9, 2006 (DE) ..... 10 2006 058 092

(51) Int. Cl.
*B42C 11/02* (2006.01)

(52) U.S. Cl. ..... 412/19
(58) Field of Classification Search ..... 281/21.1; 412/5, 22, 19
See application file for complete search history.

(56) References Cited

U.S. PATENT DOCUMENTS

| | | | | |
|---|---|---|---|---|
| 2,921,322 | A | 1/1960 | Crawley et al. | |
| 5,141,377 | A * | 8/1992 | Rathert | 412/22 |
| 2006/0140742 | A1 * | 6/2006 | Brommer et al. | 412/22 |

FOREIGN PATENT DOCUMENTS

| | | | |
|---|---|---|---|
| DE | 3905767 | A1 | 8/1990 |
| DE | 44 22 783 | A1 | 1/1996 |
| DE | 4422783 | A1 | 1/1996 |
| DE | 10200406 1995 | A1 | 7/2006 |
| DE | 102004061995 | A1 | 7/2006 |

* cited by examiner

*Primary Examiner* — Dana Ross
*Assistant Examiner* — Matthew G Katcoff
(74) *Attorney, Agent, or Firm* — Alix, Yale & Ristas, LLP

(57) ABSTRACT

In a binding-in machine (40) for pressing in and joint forming books (1), the invention proposes that the delivery device (45) features a book gripper (45.1) with a pair of opposite joint gripping rails (45.4, 45.5) that take hold of the books (1) in the formed case joints (1*c*) and the distance between which can be varied, wherein the formed and pressed-in books (1) can be removed from the pressing devices (41) with said book gripper. The books (1) are reliably separated from the pressing plates (41.1) due to the inwardly directed movement of the joint gripping rails and subsequently pulled out of the pressing devices (41). The gripped removal makes it possible to realize a secondary forming or stabilizing of the formed case joints and to produce a glued connection between the case and the book block.

20 Claims, 3 Drawing Sheets

BINDING-IN MACHINE WITH BOOK DELIVERY

BACKGROUND

The invention pertains to a binding-in machine for pressing in and joint forming books.

After casing-in the book block in a case, a crease-free and permanent glued connection between the end sheets of the book block and the inner surfaces of the case is produced by pressing in the book. In industrial book production, this full surface pressing step is carried out on so-called binding-in machines in combination with the joint forming, in which the case joints are formed and glued.

DE 44 22 783 A1 describes a binding-in machine, in which a series of pressing devices are arranged on a rotor that is intermittently driven about a vertical axis of rotation, wherein the pressing plates are arranged quasi-tangentially on the rotor circumference. The joint forming devices with the heated joint forming rails are situated on the pressing devices and moved forward together therewith. From the infeed to the delivery, the books are permanently held over the entire surface in one and the same pressing device. In this case, the joint forming rails may remain closed in an uninterrupted fashion.

In the delivery, the books fall onto a punch positioned underneath the pressing devices with their spine after the pressing plates open, wherein said punch initially transports the books vertically downward, and wherein the books are subsequently set down such that they are supported by a rake and pushed on a driven roller conveyor by the punch.

When processing lightweight books with a "sticky" case (for example, a plastic case), it may occur that the books adhere to the pressing plates and do not drop out of the pressing devices in a timely fashion such that stoppages and other interruptions result during production. On the other hand, heavy books may cause deformations on the freshly formed book spine when they drop onto the punch with the spine.

SUMMARY

The invention is based on the objective of developing a binding-in machine for pressing in and joint forming books which makes it possible to reliably and gently deliver the books from the pressing devices.

This objective is attained in that the delivery device features a gripper clamp with a pair of opposite joint gripping rails that grip the books in the formed case joints and the distance between which can be varied, wherein the formed and pressed books can be removed from the pressing devices with said gripper clamp. The books are removed from the pressing devices in a gripped fashion such that very short delivery times can be realized. The books do not drop onto downstream transport system undefined in time. The delivery furthermore takes place such that the books are handled gently. When the books are taken hold of due to the inwardly directed movement of the joint gripping rails, they are reliably separated from the pressing plates and subsequently pulled out of the pressing devices such that even books with an adherent case cover are reliably delivered.

During the gripped removal, the pressing devices may be set into a guiding position, in which the pressing plates are opened by a minimal distance such that the books are laterally guided and the case is prevented from spreading open when taking hold of the case joints.

In order to laterally support the case after the books are removed from the pressing plates, at least the lateral regions of the books near the joints may be supported by guide elements. The guide elements are preferably realized in the form of supporting rails that are received on the gripper clamp and can be moved back and forward between a retracted position and a supporting position.

In order to easily take hold of the formed case joints with the gripper clamp, the joint forming rails of the joint forming device may be set to a correspondingly large distance from the book spine while the pressing device is still closed.

In is advantageous if the joint gripping rails of the gripper clamp engage into the case joints with a definable pressing force such that a controlled secondary forming or stabilizing of the formed case joints can be achieved. The advantages of a particularly effective stabilization of the case joints formed under the influence of heat and the production of a permanent glued connection between the case and the book block can be achieved by cooling the joint gripping rails of the gripper clamp.

The gripper clamp downwardly removes the books from the pressing devices essentially transverse to the joint forming rails, namely in a plane that lies parallel to the pressing plates, such that the books can be removed faster due to the shorter format width. In addition, the removal of the books is promoted by the weight of the books.

The gripper clamp is driven forward and backward such that it pivots about an axis that is oriented perpendicular to the pressing plates. It is advantageous if a downstream transport system receives the books from the gripper clamp in a vertical position such that the additional transport of the books can take place in a gentle fashion.

BRIEF DESCRIPTION OF THE DRAWINGS

The characteristics of the present invention are described below with reference to one preferred embodiment that is illustrated in the enclosed drawings, wherein.

DETAILED DESCRIPTION

Figure 1:
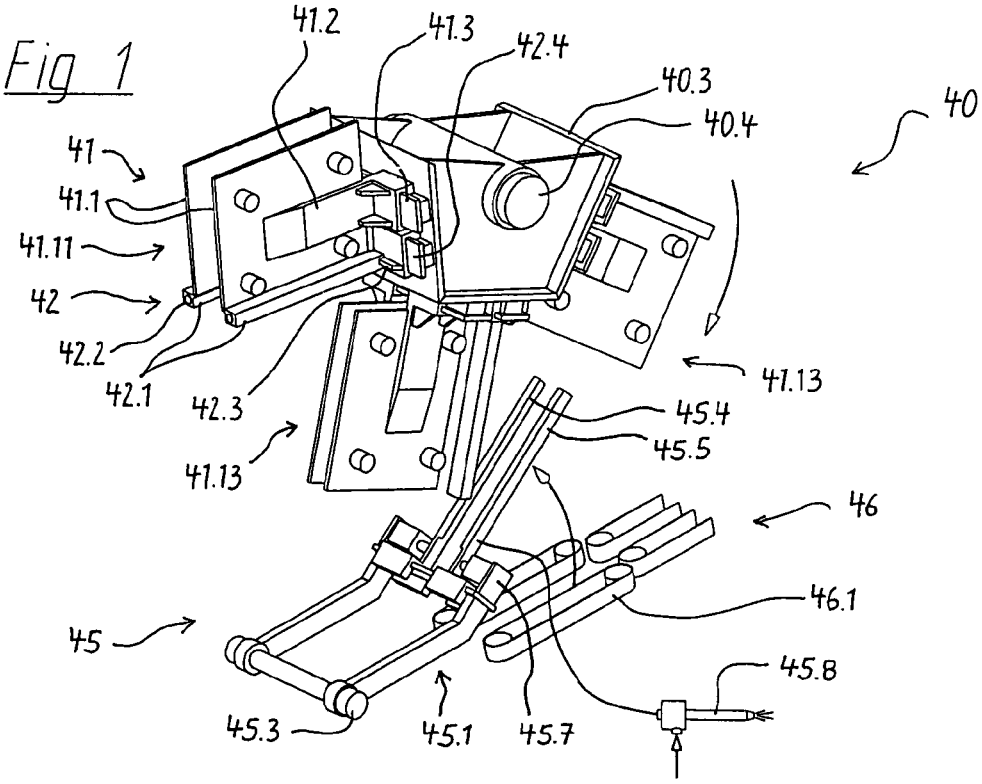
FIG. 1 shows a schematic, simplified perspective representation of a binding-in machine with a delivery station featuring a book gripper that is pivoted into the removal position.

Book blocks and cases are connected into books 1 in a casing-in machine. A crease-free and permanent glued connection between the end sheets of the book blocks and the inner pages of the cases is produced when pressing in the book 1 in a binding-in machine 40 that is arranged downstream of the casing-in machine. This full surface pressing step is carried out together with the joint forming step, in which the case joints 1*c* are formed and glued.

The binding-in machine 40 chosen for the illustration of a delivery station 45 comprises a multitude of pressing devices 41 arranged on an intermittently driven rotor 40.3, wherein the axis of rotation 40.4 of the rotor 40.3 is oriented perpendicular to the pressing devices 41 and extends horizontally such that the pressing devices 41 quasi revolve overhead in a vertical plane. Joint forming devices 42 are firmly allocated to the respective pressing devices 41, wherein the joint forming rails 42.1 of said joint forming devices essentially extend radially referred to the axis of rotation 40.4 of the rotor.

The binding-in machine 40 is designed such that the books 1 are constantly held in one and the same pressing device 41 and the joint forming rails 42.1 that are heated by means of heating rods 42.2 remain continuously closed in order to realize a gentle joint forming process.

The pressing devices 41 consist of a pair of pressing plates 41.1, the distance between which can be varied, wherein said pressing plates are received on actuating arms 41.2 and can be set into an open position 41.11, a guiding position 41.12 and a gripping position 41.13 symmetrically above the center. The actuating arms 41.2 are guided in a guide rail 41.3 mounted on the rotor 40.3. The control means for actuating the actuating arms 41.2 and therefore the pressing plates 41.1 may consist of pneumatic, hydraulic or electric driving means or engage into corresponding mechanical control curves. A specific embodiment is not illustrated in the figures in order to provide a better overview.

The joint forming rails 42.1 of the joint forming devices 42 are received on actuating arms 42.3 that are displaceably guided in guide rails 42.4 mounted on the rotor 40.3 and can be actuated with the aid of not-shown control means in order to form, hold and/or release the case joints 1*c* by means of the joint forming rails 42.1. In the release position, the joint forming rails 42.1 are spaced apart from the book spine by a large distance such that the books 1 can be infed and transported away in the plane of motion of the pressing devices 41.

Due to the intermittent rotor movement, it is possible to act upon the books 1 by means of stationary work stations in the standstill positions of the pressing devices 41, for example, in order to realize their infeed, alignment, secondary forming, pressing-in, delivery, etc.

The books that are delivered from the casing-in machine in a vertical position and with the spine 1*a* pointing upward are transferred to an infeed and alignment station 43 with the aid of a gripper clamp 30 that pivots back and forward, wherein the books 1 are turned and directly set down on an alignment table 43.1 of the infeed and alignment station 43 with their spine 1*a*. During this process, the books 1 are already situated within a pressing device 41 that is initially set to the open position 41.11 and, after pivoting out the book clamp 30, closed into the guiding position 41.12 in order to form a defined guide channel, in which the books 1 to be aligned are tightly guided.

When the alignment table 43.1 is raised into an aligning position, a forming rail 43.5 is lowered onto the fore edge cut 1*b* of the book 1, wherein said forming rail presses the book block into the case spine with an increased pressing force and secondarily forms the book block, if applicable, while the alignment table 43.1 is minimally lowered, after taking hold of the case joints 1*c* by means of the joint forming rails 42.1.

After the alignment and secondary forming process is completed, the forming rail 43.5 is upwardly moved out of the pressing plates 41.1 and the pressing device 41 is set into its gripping position 41.13, in which the books 1 are already subjected to a certain full surface pressure and/or at least reliably held for the rotative transport. In addition, the heated joint forming rails 42.1 are closed with increased pressure in order to form the case joints 1*c*. The rotor movement for respectively advancing the pressing devices 41 by one position can start in the instant, in which the forming rail 43.5 lifts off the fore edge cut 1*b* of the books 1.

During their intermittent revolution, the pressing devices 41 pass through a pressing station 44, in which an increased pressing force can be externally exerted upon the pressing plates 41.1 during the rotor standstill in order to exert the actual full surface pressure upon the books 1.

The pressing devices 41 ultimately reach the delivery station 45, in which the books 1 are once again removed from the pressing devices 41. The delivery station features a book gripper 45.1 that can be pivoted back and forward about a pivoting axis 45.3 as symbolized in the figures with corresponding arrows. The books 1 are taken hold of in the case joint 1*c* by means of left and right joint gripping rails 45.4, 45.5 that are actuated, for example, by pressure cylinders 45.7 and pulled out of the pressing devices 41 that are set into the guiding position 41.12 in order to be transferred into a delivery position 45.11.

The two joint gripping rails 45.4 and 45.5 have a cross section that corresponds to the formed case joint 1*c*, wherein the secondary forming or stabilizing of the case joint 1*c* can be realized while the books 1 are delivered from the pressing devices 41. The intensity of the secondary forming process can be influenced by adjusting the pressure of the pressure cylinders 45.7.

A particularly effective stabilization of the case joints 1*c* formed under the influence of heat is achieved by continuously cooling the joint gripping rails 45.4, 45.5, namely while simultaneously producing a permanent glued connection between the case and the book block. In the described embodiment, the cooling is realized with a (vortex tube) cooling nozzle 45.8 that delivers cooled air to the joint gripping rails 45.4, 45.5.

A removal process is described below: while a pressing device 41 is still transported into the delivery station 45, the book gripper 45.1 is pivoted into the corresponding removal position such that it quasi follows the pressing device 41, wherein the pressing device 41 is horizontally inclined referred to the assigned joint forming device 42 in said removal position.

Figure 4A:
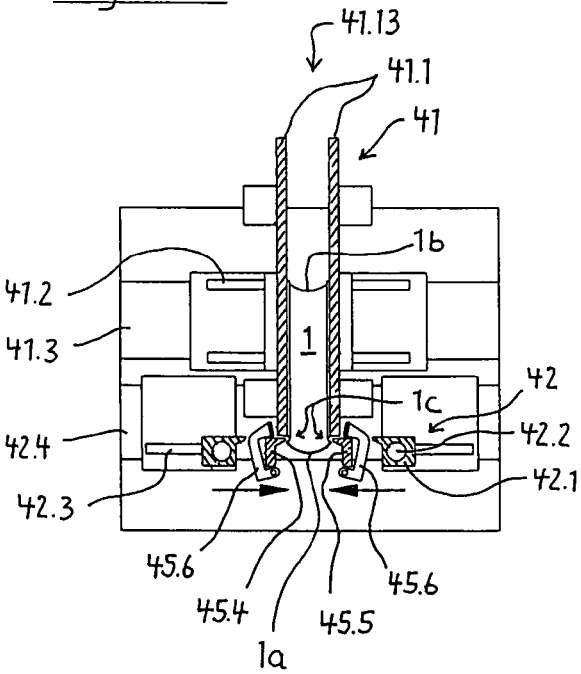
FIGS. 4*a* and 4*b* show sections through the delivery station along the line of section IV in FIG. 3, namely during different phases of the removal.

The joint forming rails 42.1 are meanwhile retracted in order to enable the joint gripping rails 45.4, 45.5 of the book gripper 54.1 to access the case joints 1*c* while the pressing plates 41.1 initially remain set to the gripping position 41.13. The case joints 1*c* are then reliably taken hold of in said removal position precisely during the common standstill of the pressing device 41 and the book gripper 45.1 (see FIG. 4*a*).

Figure 4B:
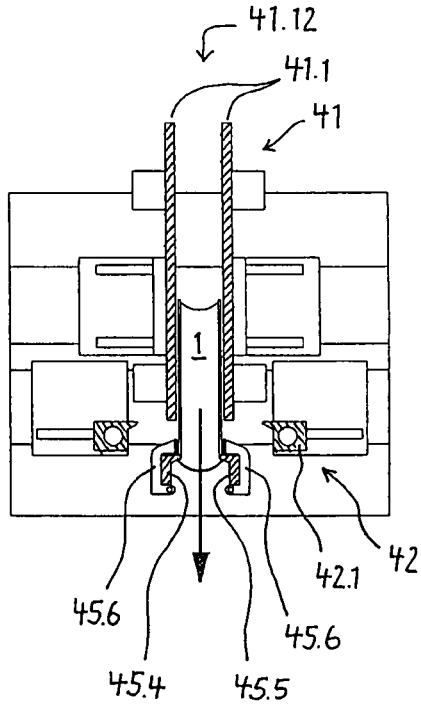

The pressing plates 41.1 are opened into the guiding position 41.12 and the book gripper 45.1 pulls the pressed-in and joint-formed book 1 out of the corresponding pressing device 41 while the book is laterally supported by the pressing plates 41.1. The additional transport of the pressing device 41 could already take place during this process such that only a very short standstill time is required for removing the books 1. Supporting rails 45.6 that are received in an articulated fashion on the joint gripping rails 45.4, 45.5 are set from a retracted position into a corresponding supporting position in order to additionally support the cases (see FIG. 4*b*).

Figure 2:
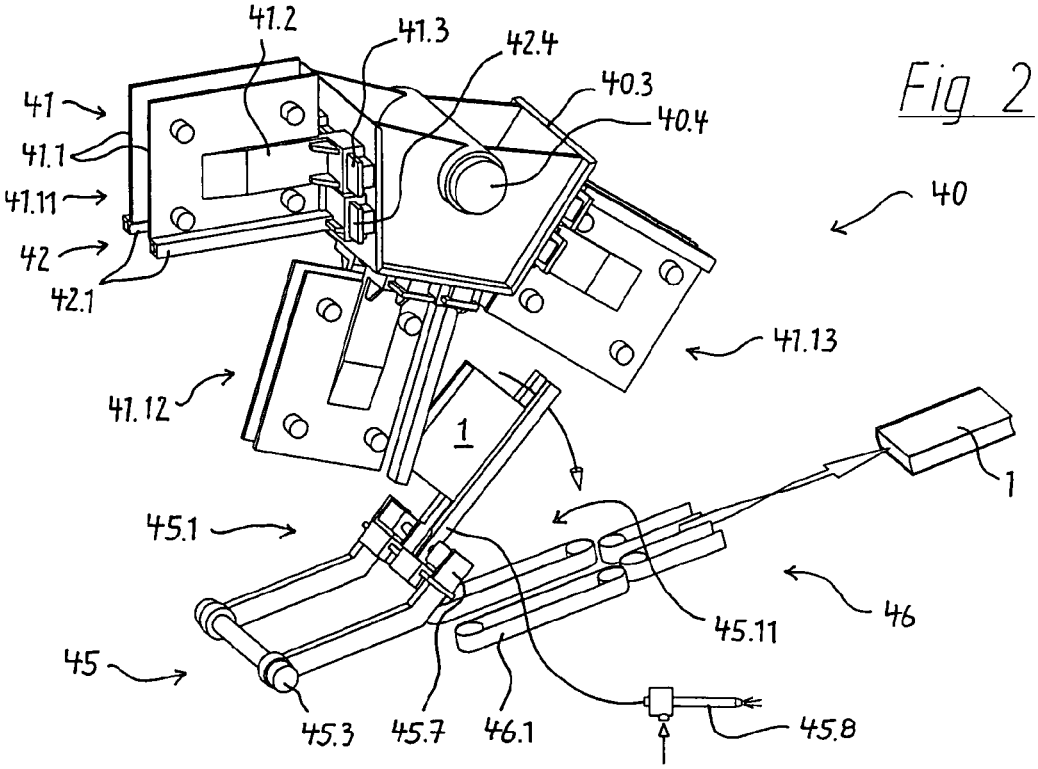
FIG. 2 shows the binding-in machine with the delivery station according to FIG. 1, namely in the instant in which the book is removed.
Figure 3:
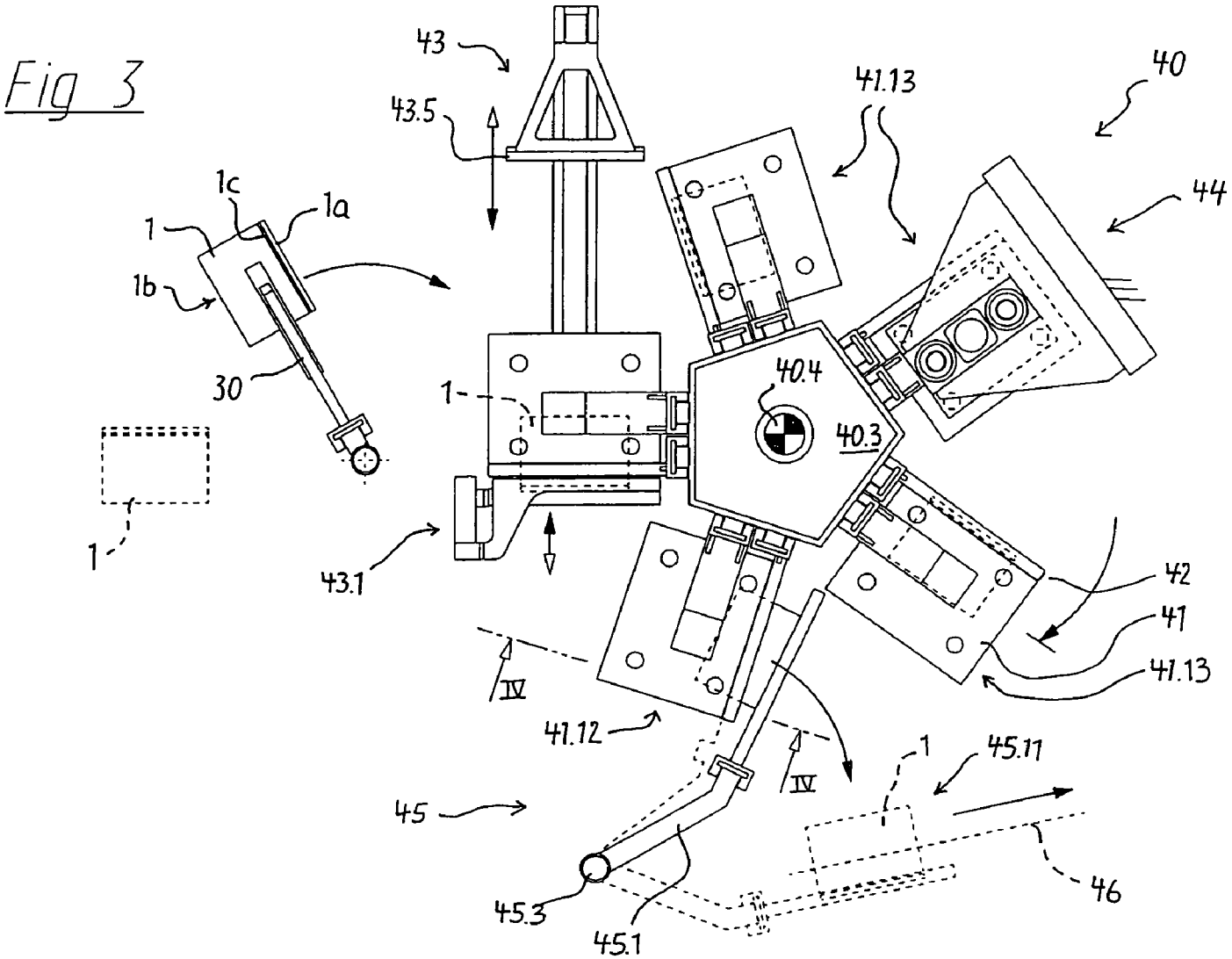
FIG. 3 shows a schematic side view of the binding-in machine.

The removed book 1 is positioned vertically when it is transferred to an additional conveyor 46 in the delivery position 45.11, in which the spine 1*a* of the book 1 is only slightly inclined referred to the horizontal line, wherein the book is transported away from the binding-in machine 40 in the direction of the book height. The additional conveyor 46 may consist, for example, of a clamping belt conveyor with a transport section 46.1 that can be opened and closed and receives the books 1 in the delivery position 45.11 and a helically extending transport section for setting down the books 1 that is symbolized by a helical transport arrow in FIG. 2.

The invention claimed is:

1. A binding-in machine for pressing in and joint forming books having a case, a book block with a fore edge cut and a spine, the machine including devices for infeeding and aligning the book block relative to the case, comprising:

a multitude of pressing devices that respectively feature a pair of opposite pressing plates the distance between which can be varied, wherein said pressing plates serve for exerting a full-surface pressing force upon the sides of the book, a case joint forming device connected to each of the pressing devices and including a pair of opposite heated joint forming rails the distance between which can be varied, wherein said joint forming rails serve for forming case joints on the books, a discharge delivery device including a book gripper with a pair of opposite joint gripping rails that take hold of the books in the formed case joints and the distance between which can be varied whereby the formed and pressed-in books can be removed from the pressing devices with said book gripper, wherein the book gripper removes the books from the pressing device in a direction essentially transverse to the joint forming rails.

2. The binding-in machine according to claim 1 wherein the pressing devices and respective case joint forming devices are operatively associated with the delivery device such the joint gripping rails of the delivery device hold and remove the books from the pressing devices while the pressing devices are in a guiding position that laterally guide the books.

3. The binding-in machine according to claim 1 further including support elements that laterally support at least the lateral regions of the books near the joints after the books are released from the pressing plates.

4. The binding-in machine according to claim 3, wherein the support elements are in the form of rails that are received on the book gripper and are moveable back and forward between a retracted position and a supporting position.

5. The binding-in machine according claim 1, wherein the joint forming rails of the joint forming device are operatively associated with the delivery device such that the joint forming rails retract laterally from the spine a distance sufficient for the joint gripping rails to take hold of the formed case joints.

6. The binding-in machine according claim 4, wherein the joint forming rails of the joint forming device are operatively associated with the delivery device such that the joint forming rails retract laterally from the spine a distance sufficient for the joint gripping rails to take hold of the formed case joints.

7. The binding-in machine according to claim 1, wherein the joint gripping rails of the book gripper take hold of the case joints with an adjustable pressing force.

8. The binding-in machine according to claim 4, wherein the joint gripping rails of the book gripper take hold of the case joints with an adjustable pressing force.

9. The binding-in machine according to claim 1, wherein the joint gripping rails of the book gripper are cooled.

10. The binding-in machine according to claim 5, wherein the joint gripping rails of the book gripper are cooled.

11. The binding-in machine according to claim 7, wherein the joint gripping rails of the book gripper are cooled.

12. The binding-in machine according to claim 1, wherein the opposed pressing plates are arranged vertically in parallel and the pressing devices and respective case joint forming devices are operatively associated with the delivery device such the book gripper downwardly removes the books from the pressing devices in a direction essentially transverse to the joint forming rails and in a plane that lies parallel to the pressing plates.

13. The binding-in machine according to claim 7, wherein the opposed pressing plates are arranged vertically in parallel and the pressing devices and respective case joint forming devices are operatively associated with the delivery device such the book gripper downwardly removes the books from the pressing devices in a direction essentially transverse to the joint forming rails and in a plane that lies parallel to the pressing plates.

14. The binding-in machine according to claim 9, wherein the opposed pressing plates are arranged vertically in parallel and the pressing devices and respective case joint forming devices are operatively associated with the delivery device such the book gripper downwardly removes the books from the pressing devices in a direction essentially transverse to the joint forming rails and in a plane that lies parallel to the pressing plates.

15. The binding-in machine according claim 1, wherein the opposed pressing plates are arranged in parallel and the book gripper is reciprocally pivotable about an axis that is perpendicular to the pressing plates.

16. The binding-in machine according claim 9, the opposed pressing plates are arranged in parallel and the book gripper is reciprocally pivotable about an axis that is perpendicular to the pressing plates.

17. The binding-in machine according claim 12, the opposed pressing plates are arranged in parallel and the book gripper is reciprocally pivotable about an axis that is perpendicular to the pressing plates.

18. The binding-in machine according claim 1, further including a transport system that receives the books from the book gripper in a vertical position.

19. The binding-in machine according claim 12, further including a transport system that receives the books from the book gripper in a vertical position.

20. The binding-in machine according claim 15, further including a transport system that receives the books from the book gripper in a vertical position.

* * * * *